US009224361B2

(12) United States Patent
Song et al.

(10) Patent No.: US 9,224,361 B2
(45) Date of Patent: Dec. 29, 2015

(54) METHOD, DEVICE AND SYSTEM FOR COMPENSATING BRIGHTNESS OF A LIQUID CRYSTAL MODULE

(75) Inventors: Zhicheng Song, Qingdao (CN); Mingsheng Qiao, Qingdao (CN); Weidong Liu, Qingdao (CN)

(73) Assignee: HISENSE HIVIEW TECH CO., LTD., Qingdao, Shandong (CN)

( * ) Notice: Subject to any disclaimer, the term of this patent is extended or adjusted under 35 U.S.C. 154(b) by 0 days.

(21) Appl. No.: 13/698,917

(22) PCT Filed: Dec. 26, 2011

(86) PCT No.: PCT/CN2011/084630
§ 371 (c)(1), (2), (4) Date: Nov. 19, 2012

(87) PCT Pub. No.: WO2013/000258
PCT Pub. Date: Jan. 3, 2013

(65) Prior Publication Data

US 2014/0210841 A1 Jul. 31, 2014

(30) Foreign Application Priority Data

Jun. 28, 2011 (CN) ..... 2011 1 0177682

(51) Int. Cl.
*G09G 5/02* (2006.01)
*G09G 3/34* (2006.01)
*G09G 3/36* (2006.01)

(52) U.S. Cl.
CPC .. *G09G 5/02* (2013.01); *G09G 3/34* (2013.01); *G09G 3/36* (2013.01)

(58) Field of Classification Search
CPC ..... G09G 2360/16; G09G 2320/0626; G09G 2320/0238; G09G 3/3406; G09G 2320/0693; G09G 2320/0233; G09G 2320/062; G09G 3/342; G09G 3/36; G09G 2320/0276; G09G 2320/0686; G09G 2320/0646; G09G 2320/02; G09G 2320/0242; G09G 3/3413; G09G 3/3233; G09G 2310/04; G02F 1/133611; H04N 5/2256; H04N 5/57; G03B 21/00; G06T 2207/30121
USPC ..... 345/589
See application file for complete search history.

(56) References Cited

U.S. PATENT DOCUMENTS 6,031,607 A * 2/2000 Miyazaki ..... 356/237.1
2005/0035311 A1* 2/2005 Asakawa et al. ..... 250/559.16

(Continued)

FOREIGN PATENT DOCUMENTS

CN 101470276 A 7/2009
CN 201374177 Y 12/2009

(Continued)

OTHER PUBLICATIONS

International Search Report (PCT/ISA/210) issued on Apr. 5, 2012, by the Chinese Patent Office as the International Searching Authority for International Application No. PCT/CN2011/084630.

*Primary Examiner* — Haixia Du
(74) *Attorney, Agent, or Firm* — Buchanan Ingersoll & Rooney PC

(57) ABSTRACT

A method for compensating the brightness of a liquid crystal module involves acquiring an image of a liquid crystal module to obtain the acquired image. The acquired image of the liquid crystal module is compared with a standard image to find a dark region. The compensation coefficient of each pixel in the dark region is calculated. In a display control circuit of the liquid crystal module, the calculated compensation coefficient of pixels is stored for compensating the backlight unit corresponding to pixels in dark region.

9 Claims, 4 Drawing Sheets

(56) References Cited

U.S. PATENT DOCUMENTS

| | | | | |
|---|---|---|---|---|
| 2007/0091042 | A1* | 4/2007 | Chung et al. | 345/88 |
| 2008/0018630 | A1* | 1/2008 | Fujino | 345/205 |
| 2009/0303171 | A1 | 12/2009 | Chang et al. | |
| 2010/0328339 | A1* | 12/2010 | Cho et al. | 345/589 |
| 2011/0050743 | A1 | 3/2011 | Park et al. | |
| 2011/0134358 | A1* | 6/2011 | Wasinger et al. | 349/61 |
| 2011/0141090 | A1 | 6/2011 | Hong et al. | |
| 2011/0285763 | A1* | 11/2011 | Bassi et al. | 345/694 |

FOREIGN PATENT DOCUMENTS

| | | | |
|---|---|---|---|
| CN | 102097071 | A | 6/2011 |
| CN | 102231016 | A | 11/2011 |

* cited by examiner

METHOD, DEVICE AND SYSTEM FOR COMPENSATING BRIGHTNESS OF A LIQUID CRYSTAL MODULE

TECHNICAL FIELD

The invention relates to liquid crystal module (LCM) in general, and more specifically relates to a method, device and system for compensating brightness of liquid crystal module.

BACKGROUND ART

A LCM is mainly composed of a fluorescent tube, a light guide plate, a polarizing film, a filter plate, glass substrates, alignment films, liquid crystal materials, thin film transistors and so on. First of all, the LCM must project light using a backlight source, and the light will first pass through a polarizing film and then through liquid crystals. At this time, the liquid crystal molecules arrangement will change the polarization angle of the light spreading through the liquid crystal, and the light also must pass through a color filter and then another polarizing film. By changing the voltage value applied to the liquid crystal to control the light intensity and the color appearing finally, a combination of different tones can be shown on a liquid crystal panel.

A backlight module is one of critical elements for the LCM. Because the liquid crystal itself is unable to give out light, the backlight module functions to provide a light source with sufficient brightness and uniform distribution so that the liquid module can display images in a normal way. A backlight module consists of an array of backlight units, each of which corresponds to a pixel. Brightness of each pixel is controlled by driving voltage of its respective backlight unit. When displaying, a standard backlight driving voltage is applied to each backlight unit.

For the LCM, issues such as technical reasons or as various zero units failing to meet the design requirements in the design and manufacturing process will lead to a phenomenon of uneven light and dark appearing in the final product. The phenomenon includes, for example, light leak problem caused by an extrusion to the LCD flat panel due to structure parts production failing to meet the precision requirement for the design, shadow caused by the failure to meet a designed mixed light distance, bright-dark uniformity caused by a uneven optical diaphragm, and other undesirable phenomenon. The above problems can be completely solved by a solution in which the design is modified and the machining accuracy of zero unit is improved, but this kind of scheme will waste a lot of manpower, financial and material resources without achieving a desired actual result.

Therefore, a method, device and system is eagerly needed in the technical field, which make detection and brightness compensation for a large number of products using the optical characteristics of a liquid crystal panel by the way of image acquisition, image processing and circuit driving in order to eliminate dark region in products and consequently improve product yield.

SUMMARY OF THE INVENTION

Embodiments of the present invention relate to a method, device and system for compensating the brightness of liquid crystal module to eliminate the dark region of the liquid crystal module.

One embodiment of the present invention discloses a method for compensating the brightness of liquid crystal module, which is characterized by that the method involves:

acquiring image of liquid crystal module to obtain an acquired image of the liquid crystal module; comparing the acquired image with a standard image to find dark region; calculating a compensation coefficient of each pixel in the dark region; storing the calculated compensation coefficient in display control circuit of the liquid crystal module for compensating the backlight unit corresponding to pixels in the dark region.

Another embodiment of the invention discloses a device for compensating the brightness of liquid crystal module, which is characterized by that the device involves: image acquiring unit, used for acquiring image of liquid crystal module to obtain acquired image of the liquid crystal module; processor, used for comparing the acquired image with a standard image to find dark region, calculating the compensation coefficient of each pixel in the dark region, and storing the calculated compensation coefficient in display control circuit of the liquid crystal module for the said display control circuit to compensate the backlight units corresponding to pixels in dark region with the compensation coefficient.

Another embodiment of the invention discloses a system for compensating the brightness of liquid crystal module, which is characterized by that the system involves: a video camera, used for acquiring image of liquid crystal module to obtain acquired image of the liquid crystal module; computer, used for comparing the acquired image of liquid crystal module with a standard image to find a dark region, calculating the compensation coefficient of each pixel in the dark region, and storing the calculated compensation coefficient in display control circuit of the liquid crystal module for the said display control circuit to compensate the backlight units corresponding to pixels in dark region with the compensation coefficient.

A method, device and system according to the embodiments of present invention eliminate product dark region of the liquid crystal module not reaching the factory standard and consequently improve product yield by means of making detection and brightness compensation for a large number of products with the aid of the image acquisition, image processing and circuit driving.

BRIEF DESCRIPTION OF THE DRAWINGS

The nature and advantages of the invention may be further understood with reference to the below appended figures. In the figures, the similar units or features may have the same reference symbols, wherein.

EMBODIMENTS

In the below description, a lot of specific details are expounded to provide thorough understanding of some embodiments. However, the skilled in the field will understand that some embodiments can also be implemented without these specific details. In other instances, there are no detailed descriptions about methods, procedures, units and/or circuits well known in the art in order not to obscure the discussion.

Embodiment 1

Figure 1:
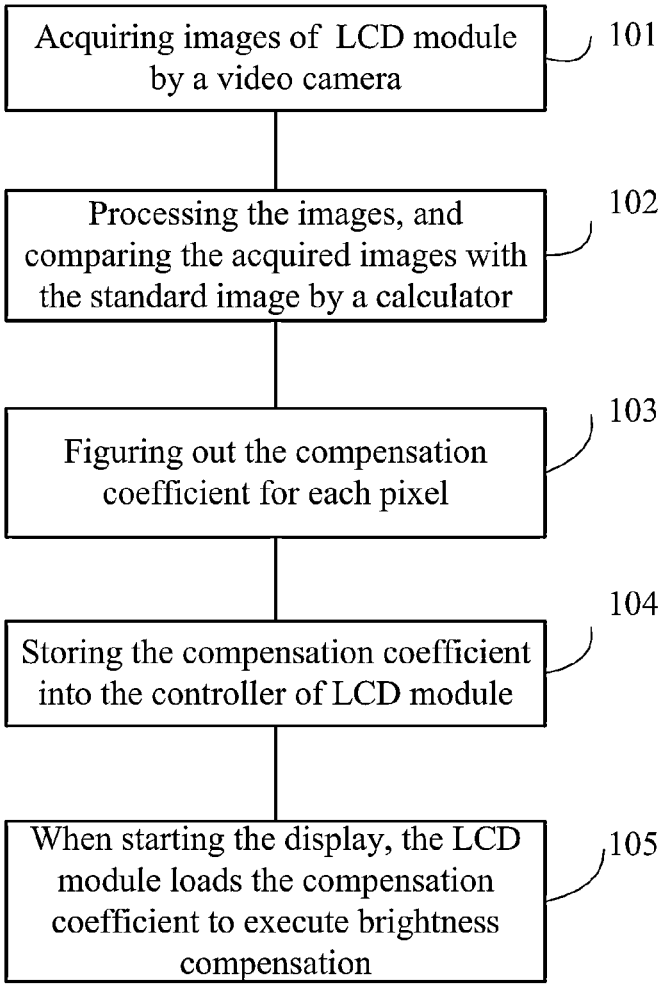
FIG. 1 is a flow chart of a method for compensating brightness of a LCM according to an embodiment of the present invention.

FIG. 1 is a flow chart of a method for compensating brightness of a LCM according to an embodiment of the present invention. In step 101, image acquiring is implemented to a liquid crystal module with scheduled image display to obtain the acquired image of the liquid crystal module. In step 102, the acquired image is compared with a standard image to find dark region. In step 103, the brightness difference between each pixel in the dark region and the corresponding pixel in the standard image is calculated to get compensation coefficients for each pixel in the dark region. In step 105, the compensation coefficients are stored into a display control circuit of the liquid crystal module. In step 105, When driving the liquid crystal module for display, the display control circuit compensates the backlight units corresponding to pixels in the dark region by using the compensation coefficients.

Embodiment 2

Figure 2:
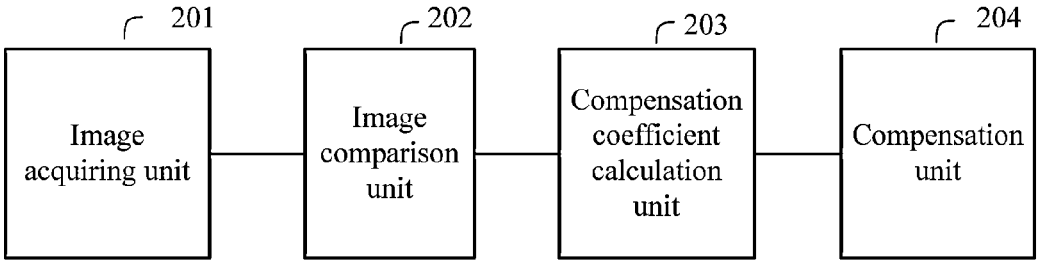
FIG. 2 is a block diagram of a device for compensating brightness of a LCM according to an embodiment of present invention.

FIG. 2 is a block diagram of a device for compensating brightness of a LCM according to an embodiment of present invention. Compensation apparatus shown in FIG. 2 includes an image acquiring unit 201 for acquiring image of liquid crystal module with scheduled image display to obtain the acquired image of the liquid crystal module. Also, the compensation apparatus also includes an image comparing unit 202 for comparing the acquired image with a standard image to find dark region. The compensation apparatus further includes a compensation coefficient calculating unit 203 for calculating the brightness difference between each pixel in the dark region and the corresponding pixel in the standard image to obtain compensation coefficients for each pixel in the dark region and storing the compensation coefficients into a display control circuit of the liquid crystal module. Additionally, the compensation apparatus includes compensating unit 204 which is used for compensating the backlight units corresponding to pixels in the dark region by using the compensation coefficient.

Figure 3:
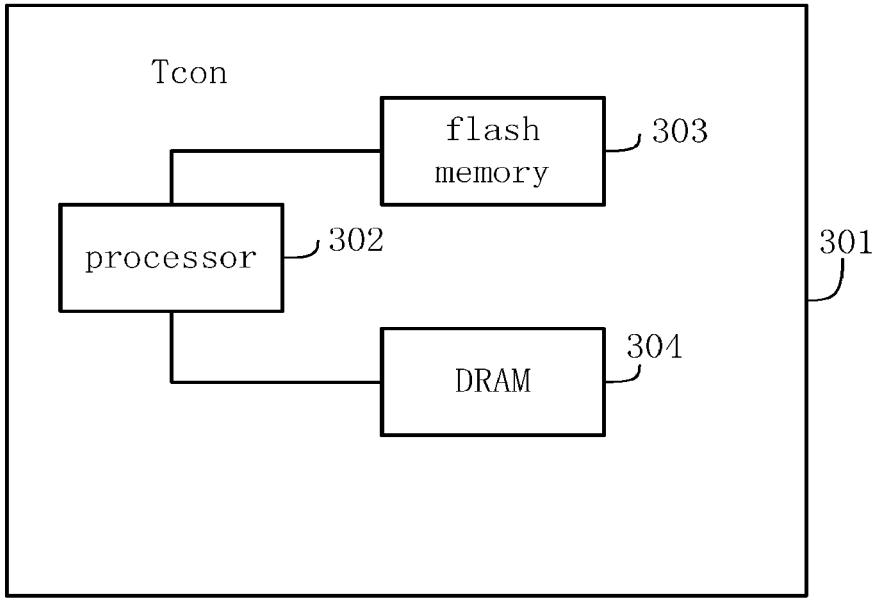
FIG. 3 is a block diagram of a display control circuit (Tcon control circuit) of a LCM according to an embodiment of the present invention.

FIG. 3 is a block diagram of a display control circuit (Tcon control circuit) of a LCM according to an embodiment of the present invention. Tcon control circuit 301 as shown in FIG. 3 includes a processor 302, a flash memory 303 and a dynamic random access memory 304. Moreover, in the calculation of compensation coefficient, a computer 403 of FIG. 4 controls the Tcon control circuit 301. The difference information is calculated by computer 403 to get compensation coefficients, and the mentioned compensation coefficients are written into the flash memory 303 of Tcon control circuit 301. After initialization of Tcon control circuit 301, the processor 302 reads the compensation coefficient written into the flash memory 303 and writes it into dynamic random access memory 304. When driving the liquid crystal module for display, Tcon control circuit 301 transforms the compensation coefficient into electrical signals to compensate the backlight units corresponding to each pixel in the dark region.

Because the backlight brightness is controlled by backlight driving voltage and proportional to the magnitude of the backlight driving voltage, increasing driving voltage of a backlight unit of a pixel can correspondingly increase the backlight brightness of the pixel. Because compensation coefficients of each pixel in the dark region have already been written into the dynamic random access memory 308, the LCM is able to be compensated automatically when being driven for display.

At first, the brightness of standard images and the acquired image are quantized using a predetermined brightness quantization unit. Because the standard images have uniform brightness, each pixel of the standard image has equivalent brightness. In one embodiment, the standard image is a normal and completely black image with one hundred percent of brightness (it may be a completely white image in other embodiments). Compensation coefficients for pixels of the normal and completely black image with one hundred percent of brightness may be defined to 0, i.e., no compensation is needed at all. Brightness of the pixel with compensation coefficient of 0 can be quantized in multistage. For example, in an embodiment the standard image is quantized with 10 orders, and in another embodiment the standard image can be quantized with more or less orders.

In an embodiment of the present invention, the 100 order quantization is taken as an example. Then, the quantization unit of the 100 order quantization is used to calculate brightness order of each pixel in each dark region. For example, if a calculated brightness order of a certain pixel is 80, then the difference value of brightness orders between the pixel and standard brightness is 20. That is, brightness of the pixel is 80/100=0.8 times of brightness of a standard brightness pixel, and it is concluded that the pixel compensation coefficient is (1/0.8)−1=0.25. In other words, 0.25 times of the standard backlight driving voltage is additionally needed to be applied to the backlight unit of the pixel to completely normalize the pixel brightness so as to reach a brightness of 100 orders.

In the same way, compensation coefficients for other pixels can be calculated, in which a bigger difference of brightness order leads to a bigger compensation coefficient and a smaller difference of brightness order leads to a smaller compensation coefficient. For example, in an embodiment, if a calculated brightness order of a pixel is 110, then the pixel is 10 orders higher than a standard brightness pixel. That is, brightness of the pixel is 110/100=1.1 times the brightness of a standard brightness pixel, and it is concluded that the pixel compensation coefficient is 1−(1/1.1)=0.091. That is, it is needed that the standard backlight driving voltage of backlight unit of the pixel should be multiplied by 0.909 or that 0.091 times of standard backlight driving voltage should be subtracted from one standard backlight drive voltage, so that the pixel brightness can be completely normalized to reach a brightness of 100 order. In the same way, compensation coefficients of other pixels can be calculated in which the backlight voltage is increased in the case of a positive compensation coefficient and decreased in the case of a negative compensation coefficient.

First, A LCM uses a standard backlight drive voltage to normally drive all the backlight modules. Then, for the pixels needing to be compensated, compensation coefficient of the each pixel is transformed into an additional drive voltage signal packet for the backlight unit of the pixel which then is added to the original standard backlight drive voltage, and the resultant voltage after the addition is applied to the backlight unit of the pixel. In this way, brightness of the pixel is increased and the brightness compensation is completed. For the above embodiments, the difference value of orders between a pixel of dark region and a standard brightness pixel is 20, thereby a compensation coefficient of 0.25 can be calculated. That is, additional voltage which is 0.25 times of the standard backlight drive voltage is needed to be applied to the backlight unit of the pixel to compensate brightness.

In another embodiment, compensation coefficient for the normal and completely black pixels with one hundred percent of brightness may be defined to 1. For this embodiment, the computer may also calculates the compensation coefficient to be 0.25+1=1.25. Then the compensation coefficient will be written into the LCM. When the LCM is in display, the compensation coefficient of each pixel is firstly read and then multiplied by the standard backlight drive voltage to obtain the respective backlight unit driving voltage of each pixel. Then, the driving voltage calculated is applied to the backlight unit of each pixel.

Embodiment 3

Figure 4:
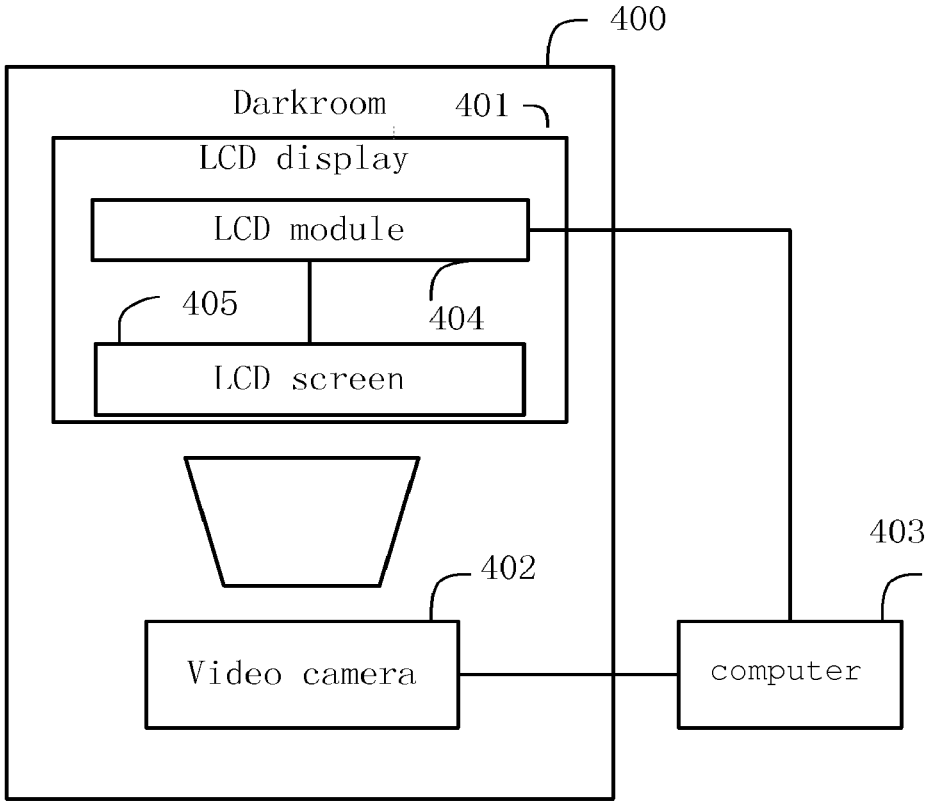
FIG. 4 is a block diagram of a system for compensating brightness of a LCM according to an embodiment of the present invention.

FIG. 4 is a block diagram of a system for compensating brightness of a LCM according to an embodiment of the present invention. Compensation system shown in FIG. 4 includes darkroom 400, LCM display 401, video camera 402 and computer 403. Video camera 402 may be a camera with charge-coupled components. LCM display 401 includes LCM 404 and LCD screen 405. In the system, the LCM display 401 and video camera 402 are located in the darkroom 400, video camera 402 can be fixed in the darkroom and totally opposite to the LCD screen 405, so that the video camera 402 can just gather a whole display image of LCD screen 405 of LCM display 401. LCM 404 and video camera 402 are connected to computer 403 respectively, so that the video camera 402 can transmit the acquired images to the computer 403 for processing, and the computer 403 can compensate LCM 404 according to the process result.

In an embodiment, one or more LCM displays 402 may be put in an assembly line. Images are acquired automatically from the LCM with standard image display via an automatic detection system composed of the camera with charge-coupled components, so that each LCM display 401 can be compensated respectively by acquiring images of LCM display 402 in the darkroom 400 each time.

In order to obtain the area with display brightness difference in LCM display 401 by comparison, the present invention defines a standard image. The standard image is an image wherein brightness of each pixel is completely coincident. The standard image is stored in computer 403 in advance. The standard image can also be collected on the assembly line in the darkroom 400. The acquired image should have the same display content setting such as all black or all white and the same brightness and color settings such as the luminance values of all the acquired images preset to 100% as the standard image in order to avoid the deviation of the comparison results. The video camera 402 is fixed, so the image of each LCM display 401 on the assembly line taken by video camera 404 in the darkroom is of a fixed image size.

Figure 5A:
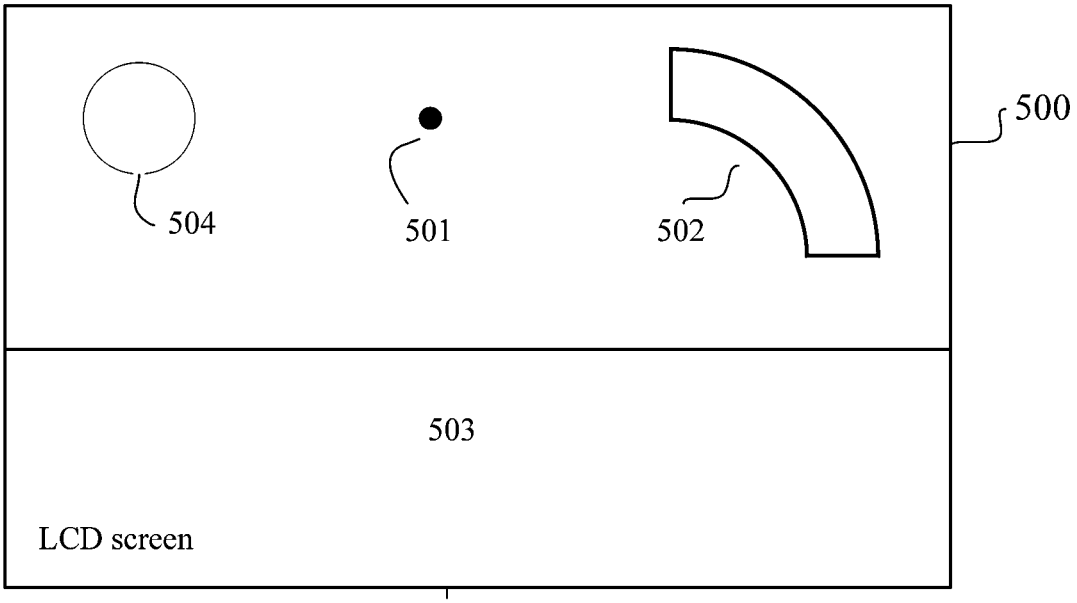
FIG. 5A is an acquired image of a liquid crystal screen which needs to be compensated according to an embodiment of the present invention.

FIG. 5A is an acquired image of a liquid crystal screen which needs to be compensated according to an embodiment of the present invention. As shown in FIG. 5A, dark regions with various shapes exist in the acquired image. In the acquired image, the dark region 501 is a single pixel, dark region 502 is an arc area, dark region 503 is a horizontal linear bar area with the same width as the screen, and dark region 504 is a circular area. Brightness values of dark regions 501, 502, 503 and 504 may be different from each other, and brightness value of each pixel in dark regions 501, 502, 503 or 504 may also be different from each other, thus the compensation coefficients needed for each area are different too. In the embodiment of FIG. 5A, it is assumed that the computer, by means of comparison, figures out a compensation coefficient of 0.8 for the pixel in the single pixel dark region 501, a compensation coefficient of 0.6 for each pixel in the arc dark region 502, a compensation coefficient of 0.5 for each pixel in the horizontal linear bar dark region 503, and a compensation coefficient of 0.2 for each pixel in the round dark region 504. Then, backlight unit of each pixel is able to be compensated respectively by the calculated compensation coefficients.

Figure 5B:
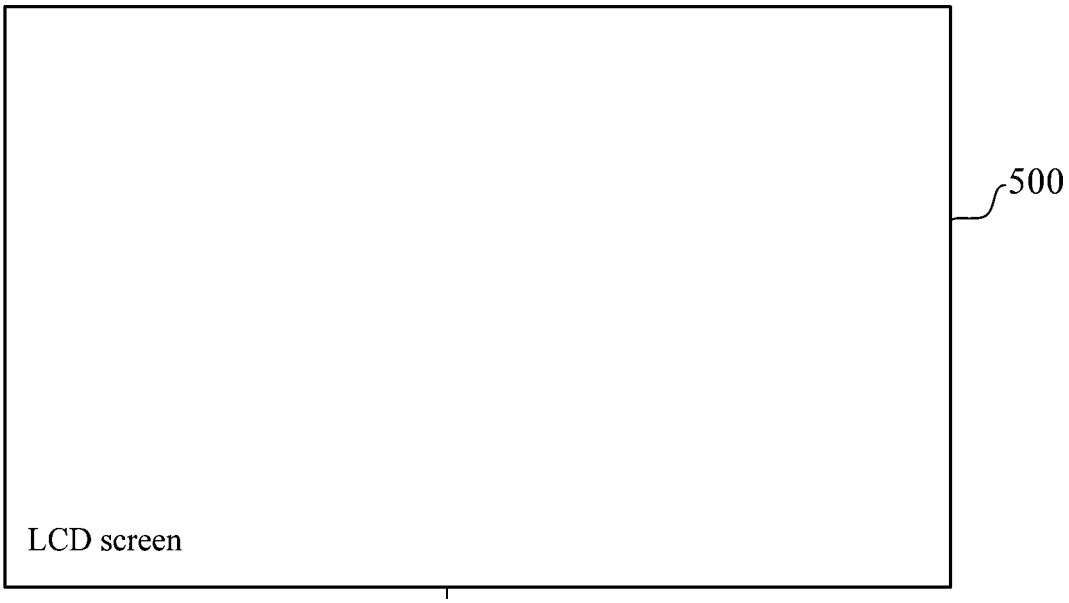
FIG. 5B is a diagram of the acquired image shown in FIG. 5A after compensation.

For single pixel dark region 501, it is only needed that row coordinate x1 and column coordinates y1 of the pixel are calculated, after which the backlight unit with coordinates (x1, y1) is applied a compensation coefficient of 0.8. For arc dark region 502, it is needed that row coordinates and column coordinates of each pixel are calculated after which the backlight units with the said coordinates is applied a compensation coefficient of 0.6. For linear bar dark region 503, it is only needed that the row coordinate x' of the line bar dark region 503 is calculated after which each pixel of the backlight unit with the row coordinate x' is applied a compensation coefficient of 0.5. For circular dark region 504, it is needed that row coordinates and column coordinates of each pixel are calculated after which each backlight unit with the said coordinates is applied a compensation coefficient of 0.2. The compensated acquired image of LCD screen is as shown in FIG. 5B.

Figure 6:
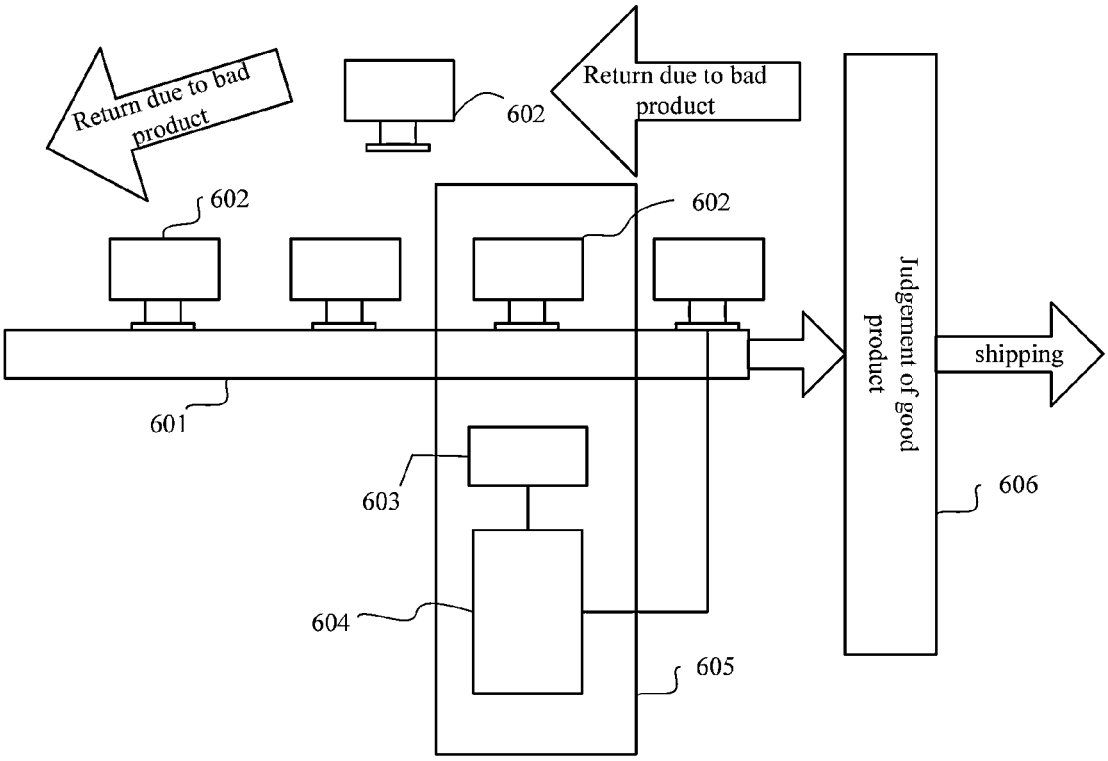
FIG. 6 is a block diagram of an assembly line for compensating brightness of a LCM according to an embodiment of the present invention

FIG. 6 is a block diagram of an assembly line for compensating brightness of a LCM according to an embodiment of the present invention. As shown in FIG. 6, this assembly line includes a conveyor belt 601, multiple LCM displays 602, a video camera 603, a computer 604, a darkroom 605 and a good product judgment mechanism 606. Before making judgment of good product for the LCM display 602, firstly the LCM displays 602 are put into darkroom 605 equipped with video camera 603 and computer 604 in turn to carry out the above mentioned image acquisition, image processing and compensation coefficient calculation. Compensation coefficient is written into darkroom 605 either in the darkroom or outside the darkroom after it is calculated. Because of the faster speed of the flow process, compensation coefficient is usually written outside the darkroom in order to guarantee the speed of the flow process.

In the good product judgment, LCM display 602 will be compensated by the compensation coefficient in display. If detecting result of the LCM display 602 reaches a good product level, the LCM will be packaged and shipped. If the LCM display 602, which has been compensated by a calculated compensation coefficient, is still unable to reach the level of good product, or if a certain LCM display 602 with dark regions is undetected in the darkroom 605 and therefore determined not reaching the good product level by good product judgment mechanism 606, then these LCM displays 602 will be returned to the assembly line to be processed repeatedly with the above procedure, and will not be packaged and shipped until they reach the good product level.

The above discussion is provided in order to enable the skilled of the technical field to make and use the present invention. When not exceeding the invention spirit and range defined in this disclosure, the general principle described in this disclosure can be used for the embodiments and application besides the above details described. The present invention is not limited to the shown embodiments, but conforms to the widest range of the principle and characteristics in this disclosure.

The invention claimed is:

1. A method of compensating the brightness of a liquid crystal module, the method comprises:

acquiring an image of an image displayed by the liquid crystal module to obtain an acquired image;

comparing the acquired image with a standard image to find a dark region;

calculating a compensation coefficient for each pixel in the dark region, wherein the step of calculating the compensation coefficient for each pixel in the dark region comprises: executing multi-step quantization for brightness of the acquired image in the dark region by means of a predetermined brightness quantization unit; calculating brightness step difference between each pixel in the dark region and a corresponding pixel of the standard image; calculating a ratio of the brightness step difference between a brightness of each pixel in the dark region and a brightness of the corresponding pixel of the standard image; and taking the ratio as the compensation coefficient; and storing the calculated compensation coefficient in a display control circuit of the liquid crystal module;

when the liquid crystal module is driven for display, compensating backlight units corresponding to the pixels in the dark region.

2. The method for compensating the brightness of a liquid crystal module according to claim 1, wherein the display control circuit includes processor, flash memory and dynamic random access memory, and the step of storing compensation coefficient in the display control circuit of the liquid crystal module includes:

writing the compensation coefficient into the flash memory of the display control circuit; and writing the written compensation coefficient into the dynamic random access memory.

3. The method for compensating the brightness of a liquid crystal module according to claim 1, wherein the step of the display control circuit compensates the backlight unit corresponding to the pixel in the dark region with the compensation coefficient includes:

when driving the liquid crystal module for display, transforming the compensation coefficient into electrical signals;

compensating the backlight unit corresponding to each pixel in the dark region with the said electrical signals.

4. The method for compensating the brightness of a liquid crystal module according to claim 1, wherein the acquired image and the standard image are both all white or all black images with an equivalent pixel setting.

5. The method for compensating the brightness of a liquid crystal module according to claim 1, wherein the display control circuit transforms the compensation coefficient to an increment for the driving voltage of the backlight unit.

6. A device for compensating the brightness of a liquid crystal module, the device comprises:

one or more processors configured to:

acquire an image of an image as displayed by the liquid crystal module to obtain an acquired image of the liquid crystal module;

compare the acquired image with a standard image to find a dark region; and calculate a compensation coefficient of each pixel in the dark region and storing the calculated compensation coefficient in a display control circuit of the liquid crystal module in order to compensate the respective backlight units corresponding to the pixels in the dark region;

wherein, said one or more processors is/are configured to execute multi-step quantization for brightness of the acquired image in the dark region with a predetermined brightness quantization unit;

calculate a brightness step difference between each pixel in the dark region and a corresponding pixel of the standard image;

and the compensation coefficient is a ratio of the brightness step difference between a brightness of each pixel in the dark region and a brightness of the corresponding pixel of the standard image.

7. A device for compensating the brightness of a liquid crystal module according to claim 6, wherein:

the display control circuit comprises a processor, a flash memory and a dynamic random access memory;

when executing the storing, the processor of the display control circuit stores the calculated compensation coefficient into the flash memory of the display control circuit of the liquid crystal module;

when executing the compensation, the display control circuit writes the written compensation coefficient in the flash memory into the dynamic random access memory, and transforms the compensation coefficient into driving electric signals of the backlight units corresponding to each pixel in the dark region.

8. A system for compensating the brightness of a liquid crystal module, the system includes:

a video camera for acquiring an image of a liquid crystal module to obtain an acquired image;

a computer configured to compare the acquired image with a standard image to find a dark region and to calculate a compensation coefficient of each pixel in the dark region, and to store the calculated compensation coefficients in a display control circuit of the liquid crystal module for compensating a respective backlight unit corresponding to each of the pixels in the dark region;

wherein the computer is configured to include a quantization unit for:

executing a multi-step quantization for brightness of the acquired image in the dark region with a predetermined brightness quantization unit;

and the computer is further configured to calculate a brightness step difference between each pixel in the dark region and a corresponding pixel of the standard image;

and the compensation coefficient is a ratio of the brightness step difference between the brightness of each pixel in the dark region and a brightness of the corresponding pixel of the standard image.

9. A system for compensating the brightness of a liquid crystal module according to claim 8, wherein:

the display control circuit includes a processor, a flash memory and a dynamic random access memory;

when executing storing, the computer stores compensation coefficient into the flash memory of the display control circuit of the liquid crystal module;

when executing compensation, the display control circuit writes the written compensation coefficient in the flash memory into the dynamic random access memory, and transforms the compensation coefficient to driving electric signals of the backlight corresponding to each pixel in the dark region.

* * * * *